US007450732B2

(12) United States Patent
Kragelund

(10) Patent No.: US 7,450,732 B2
(45) Date of Patent: Nov. 11, 2008

(54) ELECTRICAL AND MECHANICAL CONNECTION BETWEEN HEAD WORN COMMUNICATION DEVICE AND ACCESSORY THERETO

(75) Inventor: Lasse Kragelund, Smørum (DK)

(73) Assignee: Oticon A/S, Smørum (DK)

( * ) Notice: Subject to any disclaimer, the term of this patent is extended or adjusted under 35 U.S.C. 154(b) by 0 days.

(21) Appl. No.: 10/560,592

(22) PCT Filed: May 13, 2004

(86) PCT No.: PCT/DK2004/000340

§ 371 (c)(1),
(2), (4) Date: Feb. 8, 2006

(87) PCT Pub. No.: WO2004/112431

PCT Pub. Date: Dec. 23, 2004

(65) Prior Publication Data

US 2006/0126875 A1 Jun. 15, 2006

(30) Foreign Application Priority Data

Jun. 13, 2003 (DK) ..... 2003 00887

(51) Int. Cl.
*H04R 25/00* (2006.01)

(52) U.S. Cl. ..... 381/323; 381/324; 381/330

(58) Field of Classification Search ..... 381/314, 381/322, 323, 324, 327, 330, 381, 312, 60
See application file for complete search history.

(56) References Cited

U.S. PATENT DOCUMENTS

| | | | | |
|---|---|---|---|---|
| 4,539,439 | A | 9/1985 | Strothmann et al. | |
| 6,731,770 | B1 * | 5/2004 | Vonlanthen | 381/330 |
| 7,068,804 | B2 * | 6/2006 | Batting | 381/330 |
| 2002/0131614 | A1 | 9/2002 | Jakob et al. | |

FOREIGN PATENT DOCUMENTS

| | | |
|---|---|---|
| DE | 3032311 | 3/1981 |
| DK | 200200731 | 9/2002 |
| EP | 0806885 | 11/1997 |
| WO | 0079834 | 12/2000 |
| WO | 0251203 | 6/2002 |

* cited by examiner

*Primary Examiner*—Huyen D Le
(74) *Attorney, Agent, or Firm*—Dykema Gossett PLLC

(57) ABSTRACT

An electrical and mechanical connection between a head worn communication device and an accessory thereto wherein mechanical connection means and electrical connection points at the communication device are placed at one and the same surface part, and further connection means and electrical connection points at the accessory are placed at one and the same surface part, such that a sliding action between the two surface parts will cause the respective mechanical connection means to grip each other while the respective electrical connection points gain contact with each other.

3 Claims, 7 Drawing Sheets

ELECTRICAL AND MECHANICAL CONNECTION BETWEEN HEAD WORN COMMUNICATION DEVICE AND ACCESSORY THERETO

AREA OF THE INVENTION

The invention relates to a connection between a head worn communication device and an accessory thereto. The communication device could be a hearing aid of the BTE—(Behind The Ear) or ITE—(In The Ear) type or a headphone or a headset. The accessory could be a device for receiving radio frequencies for either programming or communicational purposes or it could be a standard adapter of such radio frequencies receiving devices. Also the accessory could be a simple adapter for a wired input to the hearing aid, headset or headphone for either transmitting an audio signal or for programming or other purposes.

BACKGROUND OF THE INVENTION

Connections between a head worn communication device like a hearing aid and RF receiving devices or adapters for various purposes are well known, but they often suffer from the problem, that they quite easily gets dis-engaged from the hearing aid and thus are in danger of being lost. Also they are fastened to the device in a way, which will not allow them to look as an integrated part of the communication device. They usually looks as bulky ad-ons to the device. As theses receiving devices are very expensive, it has been tried in many ways to secure the receiving means to the communication device or hearing aid.

From WO 0251203 a communication system is known which comprises a housing adapted for placement behind an ear wherein the housing has a battery compartment which is pivotally mounted on the housing, and which has a recess. The communication system further comprises a communication element, which has a protruding element adapted for engagement with the recess in the battery compartment in such a manner that the communication element maybe pivoted together with the battery compartment.

This prior art system suffers from various shortcomings:

- The battery lid hinge is stressed, and it is in risk of braking when the device is used.
- The electrical connections between the accessory and the hearing aid run the risk of being coated with a metal/oxide layer, which may cause malfunction of the electrical connection between the accessory and the hearing aid.
- Difficult to handle when the module is to be connected the hearing aid, because the user has to hold the hearing aid, the battery drawer and the module at one and the same time and this often leaves the user with not enough hands to safely attach the module.

EP 0806885 discloses a holding device for accessories mountable on a hearing aid, where the holder or so-called 'audio-shoe' has a housing open at the front which can be slid over one end of the hearing aid for removable attachment of the holder on the hearing aid. Hereby the holder or accessory will naturally become more bulky than necessary as the hearing aid is embraced by the accessory.

These prior art devices are both bulky and very difficult to operate. The aim of the invention is to provide a connection between a head worn communication device like a hearing aid and an accessory, which is both easy to operate, safely secures the accessory to the device, provides reliable electrical contact between the device and the accessory and which also is not bulky.

SUMMARY OF THE INVENTION

In a first embodiment the invention comprises an electrical and mechanical connection between a head worn communication device and an accessory thereto. According to the invention mechanical connection means and electrical connection points at the communication device are placed at one and the same surface part, and further connection means and electrical connection points at the accessory are placed at one and the same surface part, such that a sliding action between the two surface parts will cause the respective mechanical connection means to grip each other while the respective electrical connection points gain contact with each other.

When the electrical connection points of the communication device and the accessory are brought into contact through a sliding action it is assured, that corrosive layers or other deposits on the contact surfaces are scraped off each time the connection is established. This helps to provide a very reliable electrical connection. Further when both the electrical connection points and the mechanical connection means are placed at one and the same surface part of the communication device and the accessory respectively, it is possible to make an accessory, which is not bulky, and which does not protrude beyond the outline of the corresponding communication device.

Preferably the connection means comprise a hook like protrusion and a complementary cut out region at the respective surfaces of the communication device and the accessory, whereby the cut out region accommodates the hook like protrusion when the two parts are connected by the sliding action. When the protrusion of the one part is accommodated within the cut out region of the other part a very stable mechanical connection is established between the two surface parts.

Further according to the invention the hook like protrusion has a wide part spaced from the corresponding surface and free space is arranged at the complementary surface behind the cut out region for accepting the wide part of the hook like protrusion. The wide part of the hook like protrusion helps to assure that the two parts are secured against tilting and rotational action with respect to each other, and this is most important, as such action could cause the electrical connection points to dis-engage and cause loss of electrical connection.

In an embodiment of the invention the communication device has a battery and a battery lid, where the connection means of the communication device is arranged adjacent to the battery lid, such that release of the accessory from the communication device is prevented when the battery lid is in the closed position. In this way a very secure connection is established between the two parts. Further as the closure of the battery lid actually locks the two parts together, a design which does only require a small assembly force can be chosen, and this provides further user-friendliness.

By choosing a child proof battery lid, the connection between the communication device and the accessory becomes tamper resistant, and this is an advantage if the communication device is to be used with small children.

According to the invention the connection means between the communication device and the accessory comprises a frictional lock, such that the accessory will stay with the communication device also when the battery lid is open. This is advantageous because the accessory does not accidentally fall off, when the battery lid is opened, as it will be when the battery is to be changed.

According to a further aspect, the invention comprises a hearing aid and an accessory thereto, where the hearing aid has a battery and a battery lid, where connection means at the hearing aid is arranged adjacent to the battery lid, such that release of the accessory from the hearing aid is prevented when the battery lid is in the closed position.

In this way it is assured that the accessory can only be coupled to or de-coupled from the hearing aid when the battery lid is in the open position. This minimizes the risk that the accessory is detached from the hearing aid by chance. Further, as the closure of the battery lid is the action which locks the accessory to the hearing aid the interaction between the two sets of connection means may be accomplished by use of a minimal force.

In an embodiment of the invention, the battery lid is child proof. This further secures the accessory to the hearing aid, which is important in the case where the user is a small child, who might tamper with the accessory. Also any rough handling of the hearing aid, which might happen during a user's participation in sports or play, will not cause the accessory to accidentally fall of the hearing aid.

In an embodiment of the invention the connection means between the hearing aid and the accessory also comprises a frictional lock, such that the accessory will stay with the hearing aid also when the battery lid is opened. The user then does not risk accidentally loosing or dropping the accessory when he/she is changing battery in the hearing aid.

In an embodiment the battery is mounted to move pivotally on an axis from an open to a closed position, and the connection means are arranged at each their surface of the hearing aid and the accessory respectively such that interaction between the two sets of connection means is cause by a sliding movement between the two surfaces in a direction essentially perpendicular to the pivotal axis of the battery.

In this way it becomes simple to arrange the connection means such that closure of the battery lid blocks any movement between the hearing aid and the accessory. Also it aids to improve the reliability of the electrical contacts, when a sliding movement brings the contact element of the accessory and the hearing aid into contact. Such a sliding movement may provide a self cleaning effect, whereby oxide layers or other residue on the contact surfaces is scraped off each time the accessory is coupled to the hearing aid.

In an embodiment the connection means are arranged at a back end surface of the hearing aid and such that the connection means only occupy a narrow area.

In this way the same connection means may be used for a number of different hearing aid styles. When the connection means only occupy a narrow area at the back-end of the hearing aid, different styles of hearing aids can use the same design of the connection means or possibly also the same design of the accessory. This also is due to the fact that the connection means come into contact through a sliding movement between the back-end surface of the hearing aid and a corresponding surface of the accessory, whereby it is assured that even if the contours of the hearing aid and the accessory are not alike, they can be assembled. It only takes the two opposed surfaces, which comprise the respective connection means to have the same curvature.

DESCRIPTION OF A PREFERRED EMBODIMENT

Figure 1:
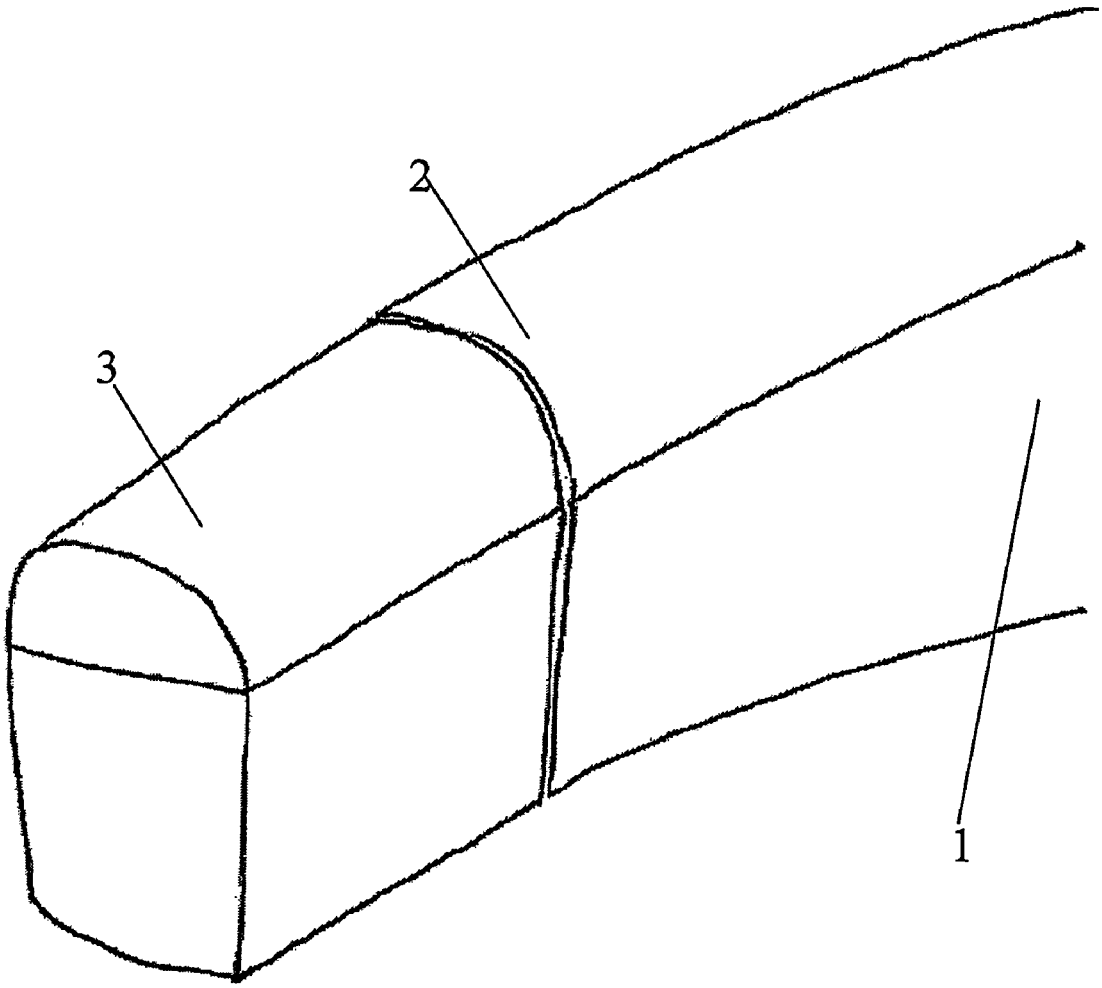
FIG. 1 is a perspective view of part of the hearing aid with the attached accessory seen from above.

FIG. 1 shows the back-end 2 of the hearing aid 1, whereto the accessory 3 is coupled.

Figure 2:
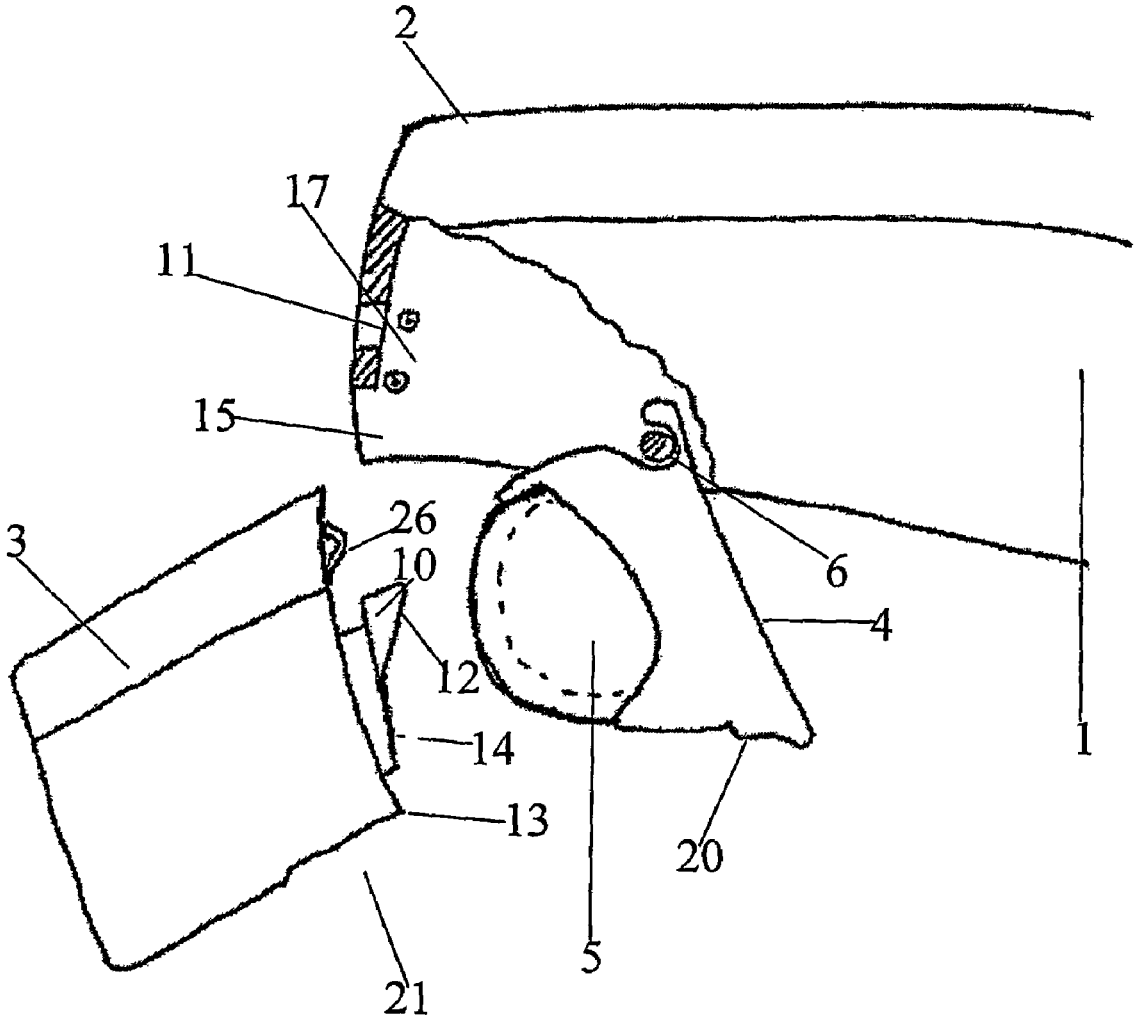
FIG. 2 shows a side view of the hearing aid and accessory spaced apart, where the battery lid is open, and where parts of the hearing aid shell are cut away to display internal structures.

In the side view of FIG. 2 the battery lid 4 is shown in the open position with a battery 5. The battery lid 4 is clicked onto a hinge pin 6, and the battery lid 4 may pivot freely about this axis 6 from a closed position (FIG. 1) to an open position (FIG. 2). Gripping parts 10 of the accessory 3 and the gripping parts 11 of the hearing aid 1 are also seen in FIG. 2. The gripping parts 10 of the accessory 3 have a protruding part 12, protruding from a surface 13. The protruding part 12 is coupled to the surface 13 through a narrow section 14.

Figure 4:
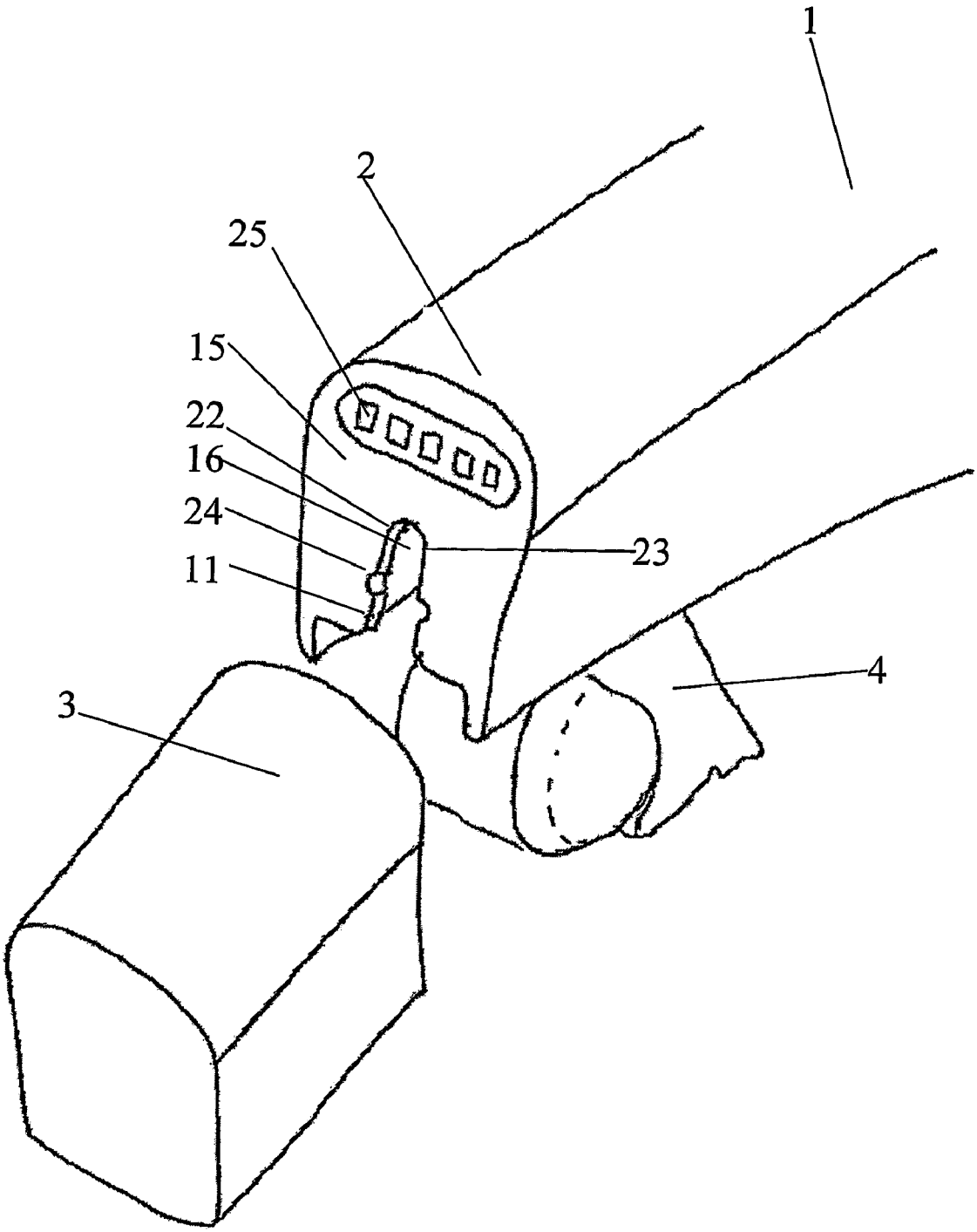
FIG. 4 is a perspective view of the hearing aid and accessory in the position displayed in FIG. 2.
Figure 5:
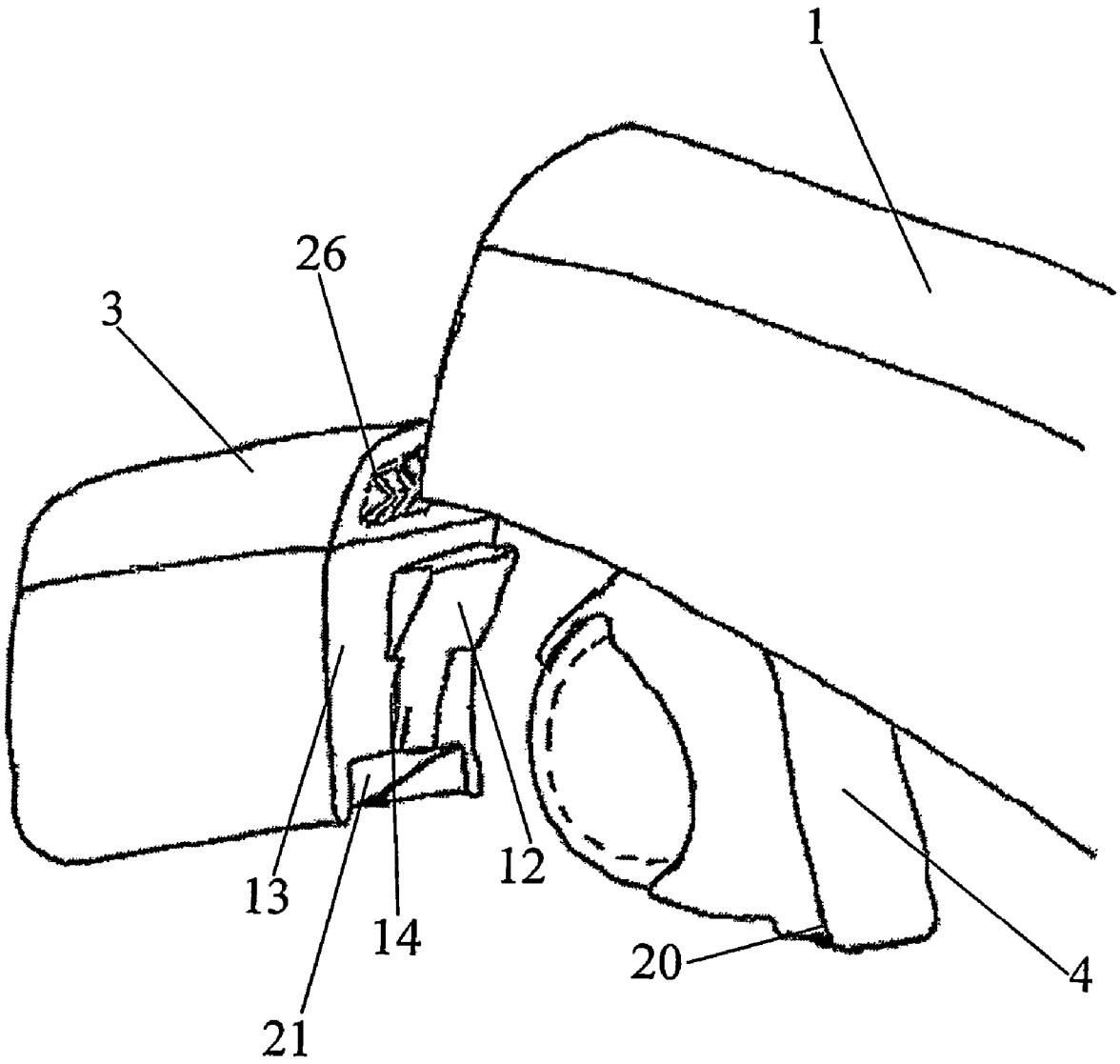
FIG. 5 is a perspective view of the hearing aid and accessory seen from a different angle.
Figure 6:
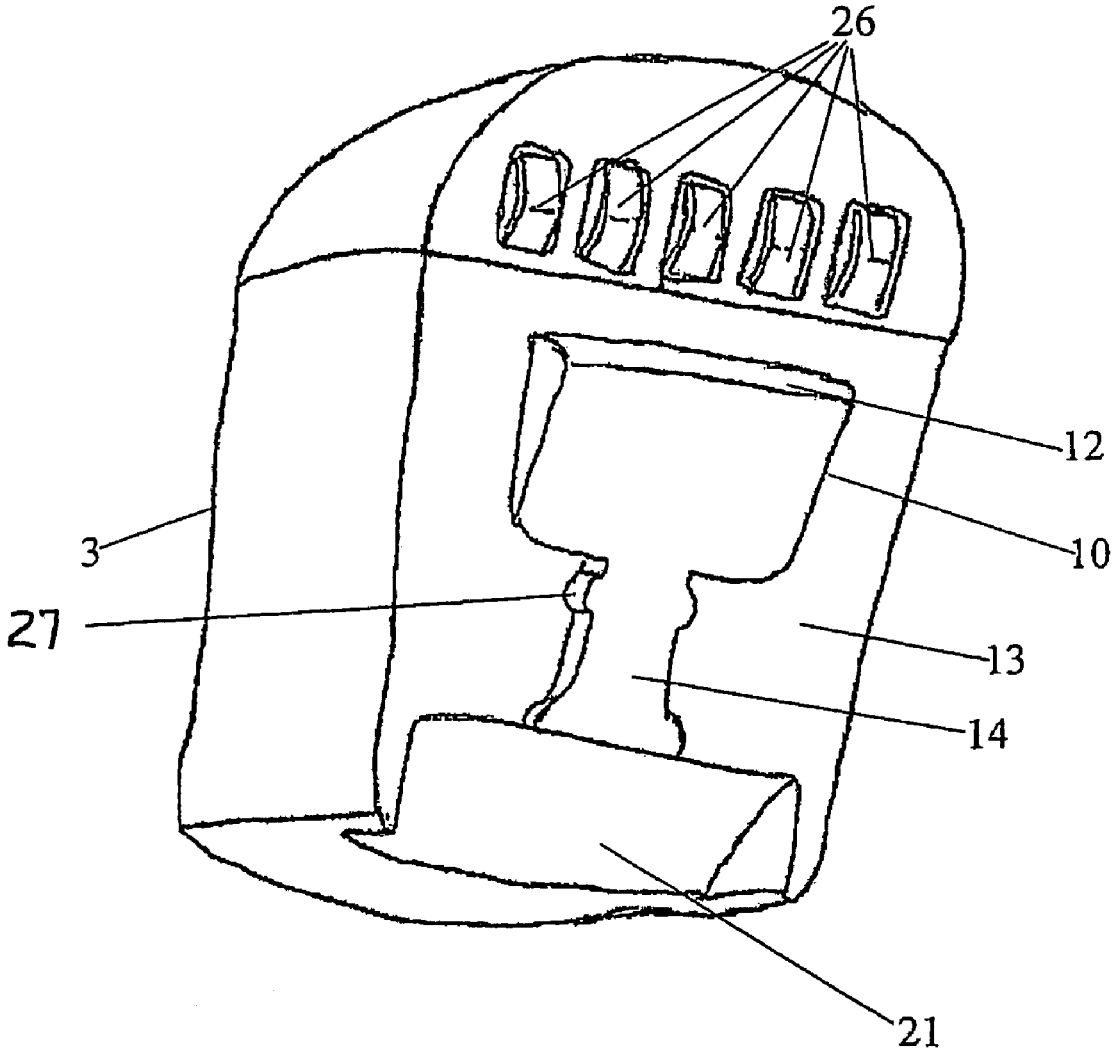
FIG. 6 is a perspective view of the accessory showing the surface with the connection means.

Referring to FIG. 4, the gripping means 11 of the hearing aid are arranged at surface 15. The gripping means 11 comprises a cut out region 16 in the surface 15, where the cut out region 16 is open in a downward direction has seen in FIG. 4. Further, a free space 17 is arranged inside the hearing aid 1 at the surface 15 as seen in FIG. 2. The cut out region 16 is bordered sideways by parallel edge parts 22 and 23 of the wall surface 15. The parallel edge parts 22, 23 each has a recess 24. The recesses receive a thickened portion 27, seen in FIG. 6, of the narrow section 14. Thereby the accessory is frictionally fastened to the hearing aid when the narrow section 14 is slid in between the edges 22 and 23 and the thickened portion 27 is lodged in the two recesses 24.

When the accessory 3 is to be assembled with the hearing aid 1 the surface 13 is cause to slide in an up-ward direction along surface 15 of the hearing aid 1, whereby the protruding part 12 will slide along the internal side of surface 15 in the free space 17. As the protruding part 12 is wider than the cut out region 16 this will lead to mutual interlocking of the hearing aid with the accessory as seen in FIG. 3.

Once the hearing aid 1 and the accessory 3 are assembled the battery lid 4 may be closed. The battery lid 4 has a shoulder 20 which in the closed position will prevent the underside of the narrow section 14 from moving in a downward direction. When the battery lid 4 is opened, the accessory 3 may slide downward and be released from the hearing aid 1.

Electrical connection points 25 are arranged at the top of the surface 15 of the hearing aid 1, and corresponding connection points 26 are arranged on the top of surface 13. When the accessory 3 is slid into position, electrical connection will be established between the two by the connection points 25,26.

Figure 3:
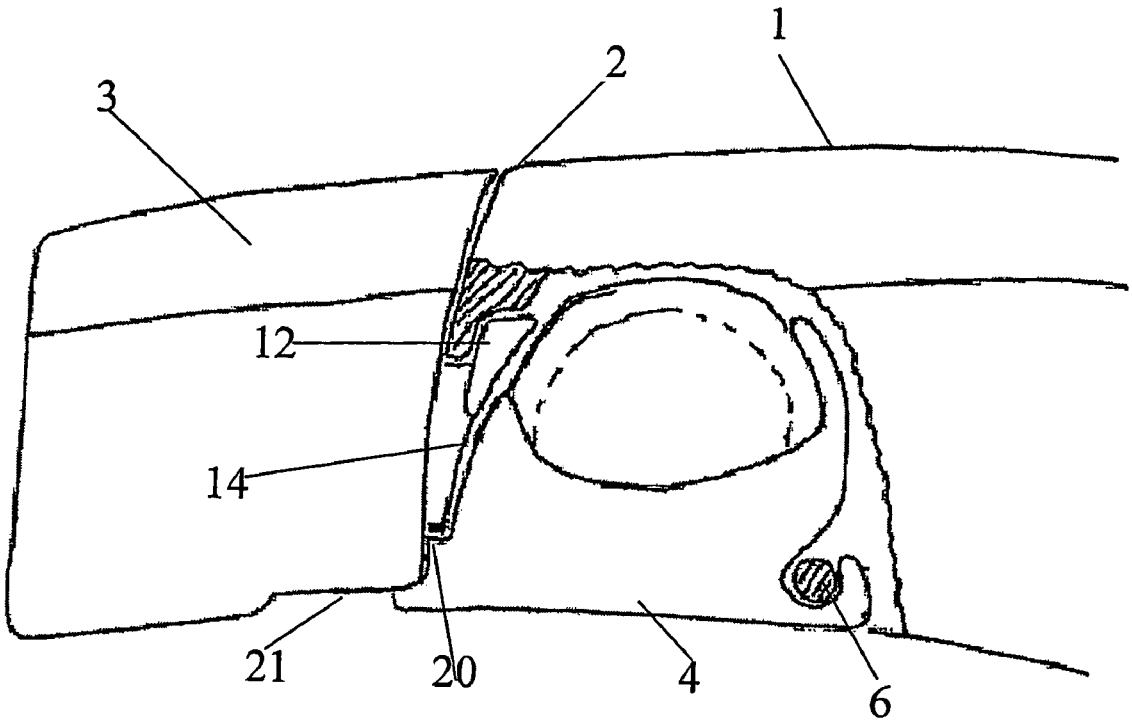
FIG. 3 is a side view as in FIG. 2, but with the hearing aid and the accessory in assembled relation.

As seen in FIG. 2 and 3 the accessory has a recess 21, which allows an edge portion 22 of the battery lid to be accessed for opening of the battery lid.

Figure 7:
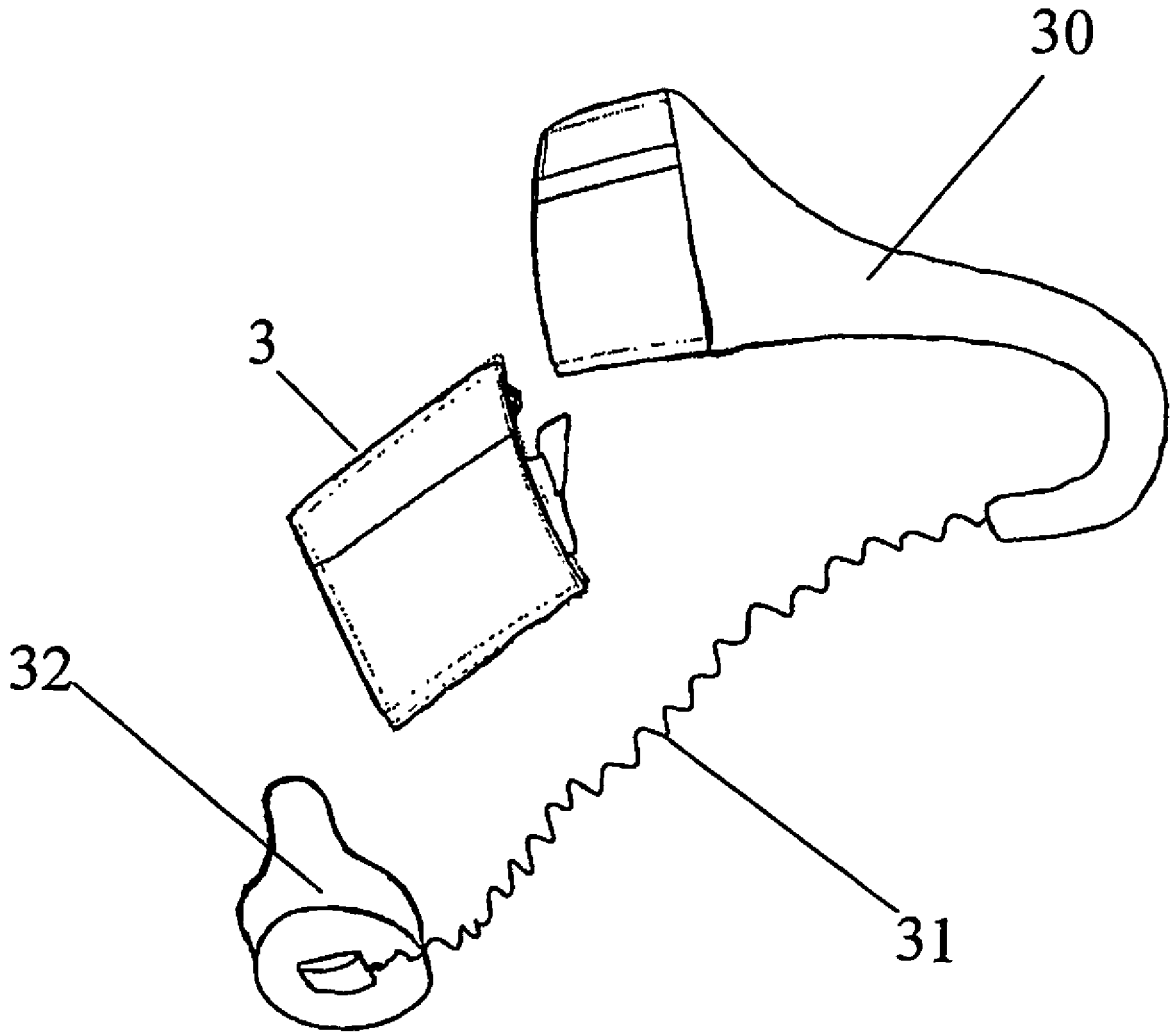
FIG. 7 is a schematic representation of a further embodiment of the hearing aid and accessory.

In FIG. 7 a further possibility is shown whereby the hearing aid has been reduced to an ear hook 30, possibly with a battery. The hook 30 has an electrical connection cord 31 to an ear piece 32. The ear piece could contain an in the ear hearing aid or just a receiver. The accessory 3 is coupled to the hook 30 with a connection of the above described kind. The ear piece 32 may hereafter receive signals from the accessory which are fed through the hook 30. This could be programming signals or an audio signal received by the accessory in the case, where the ear piece contains a hearing aid. In this way it becomes possible to receive wireless signals like FM without having an FM receiver built into the ear piece.

The invention claimed is:

1. A combination of a head-worn communication device and an accessory which can be removably attached to the communication device, said communication device having a housing and a battery lid mounted in said housing, said housing providing an external attachment surface adjacent to said battery lid which defines a cut out region and mounts electrical connectors, and said accessory having an external attachment surface with a protruding part and mounting electrical connectors, said external attachment surface of said accessory being positionable against said external attachment surface of said housing and slidable there along such that said protruding part will fit within and be gripped by said cut out region and said electrical connectors of said accessory will simultaneously contact said electrical connectors of said communication device.

2. A combination of a head-worn communication device and an accessory which can be removably attached to the communication device, said communication device comprising:

a housing which defines an end wall that defines a first cut-out region and which mounts a first set of electrical connectors, and a side wall which defines a second cut-out region that extends from said first cut-out region, and a battery lid for holding a battery and which is mounted relative to said housing for opening and closing the second cut-out region, and said accessory including an external surface which mounts a protruding part and a second set of electrical connectors, said second set of electrical connectors contacting said first set of electrical connectors after said accessory has been positioned against said end wall of said housing and slid there along and said protruding part has frictionally engaged said first cut-out region, said lid being movable relative to said housing to close said second cut-out region and fixedly position said accessory in said first cut-out region.

3. A combination as defined in claim 2, wherein said lid defines a shoulder which blocks sliding movement of the accessory when the lid is positioned to close said second cut-out region.

* * * * *